US008873765B2

(12) United States Patent
Akino

(10) Patent No.: US 8,873,765 B2
(45) Date of Patent: Oct. 28, 2014

(54) NOISE REDUCTION COMMUNICATION DEVICE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 445 days.

(21) Appl. No.: 13/441,234

(22) Filed: Apr. 6, 2012

(65) Prior Publication Data

US 2012/0259629 A1 Oct. 11, 2012

(30) Foreign Application Priority Data

Apr. 11, 2011 (JP) ..... 2011-087387

(51) Int. Cl.

| | |
|---|---|
| ***G10K 11/178*** | (2006.01) |
| ***G10L 21/0208*** | (2013.01) |
| ***H04R 1/08*** | (2006.01) |
| *G10L 21/0216* | (2013.01) |

(52) U.S. Cl.

CPC ... *G10L 21/0208* (2013.01); *G10L 2021/02165* (2013.01); *H04R 2410/05* (2013.01); *G10K 11/178* (2013.01); *H04R 1/08* (2013.01); *G10K 2210/1082* (2013.01)

USPC ..... 381/71.11; 381/72; 381/71.12; 381/94.3; 381/71.1; 379/406.08; 704/233

(58) Field of Classification Search

CPC ..... G10I 2021/0216; G10I 21/02085; H04R 2410/05; H04R 1/08; G10K 2210/1082; G10K 11/178

USPC ..... 381/71.1, 71.4, 94.3, 72, 355, 71.11, 381/317, 71.2; 704/226–228, 233, 234; 379/406.08, 406.01

See application file for complete search history.

(56) References Cited

U.S. PATENT DOCUMENTS

| | | | | | |
|---|---|---|---|---|---|
| 4,630,304 | A | * | 12/1986 | Borth et al. | 381/94.3 |
| 5,253,486 | A | * | 10/1993 | Sugahara et al. | 62/296 |
| 5,267,321 | A | * | 11/1993 | Langberg | 381/72 |
| 5,559,893 | A | * | 9/1996 | Krokstad et al. | 381/71.7 |
| 5,828,760 | A | * | 10/1998 | Jacobson et al. | 381/71.11 |
| 5,933,495 | A | * | 8/1999 | Oh | 379/406.08 |
| 6,001,131 | A | * | 12/1999 | Raman | 704/226 |
| 6,002,776 | A | * | 12/1999 | Bhadkamkar et al. | 381/66 |
| 6,091,828 | A | * | 7/2000 | Akino et al. | 381/355 |
| 6,104,816 | A | * | 8/2000 | Downs et al. | 381/94.1 |
| 2003/0039353 | A1 | * | 2/2003 | Matsuo | 379/406.01 |
| 2005/0249355 | A1 | * | 11/2005 | Chen et al. | 381/71.14 |

FOREIGN PATENT DOCUMENTS

| | | |
|---|---|---|
| JP | H05-207116 | 8/1993 |
| JP | H09-307614 | 11/1997 |

* cited by examiner

*Primary Examiner* — Vijay B Chawan
(74) *Attorney, Agent, or Firm* — Manabu Kanesaka

(57) ABSTRACT

To provide a noise reduction transmitter which can secure clarity of sounds collected in very noisy environments and maintain a quality of sounds without devising a noise insulation cover particularly.

A transmission microphone 7 is arranged inside a noise insulation cover 2 worn on and covering at least a user's 1 mouth. A noise detection microphone 9 which detects external noises is arranged outside the noise insulation cover, and a noise component cancellation circuit 11 is provided which generates a noise component cancellation signal based on an output signal from the noise detection microphone. An electroacoustic transducer 8 is arranged in the noise insulation cover to reproduce a noise component cancellation sound based on an output signal from the noise component cancellation circuit 11.

4 Claims, 2 Drawing Sheets

NOISE REDUCTION COMMUNICATION DEVICE

BACKGROUND OF THE INVENTION

1. Field of the Invention

The present invention relates to a noise reduction transmitter which can secure clarity of voices collected in very noisy environments and maintain a quality of sounds.

2. Description of the Related Art

A close-talking microphone is used in order to collect voices in a comparatively noisy environment. As examples of this close-talking microphone, a first-order pressure gradient (unidirectional) microphone unit or two first-order pressure gradient type microphone units to be a second-order pressure gradient microphone are also proposed, however there is a limit on practical use in a noisier environment.

Then, a throat microphone is proposed which takes up vibrations in the throat by means of a piezoelectric device etc. in a noisier environment. According to this throat microphone, in order to detect only vibrations of the throat, a fricative, a plosive sound, etc. which are generated at the mouth cannot be collected. For this reason, it is difficult to secure clarity of voices.

On the other hand, a "Headset Transceiver with Microphone Cover" having a function to collect sound waves generated at a mouth in very noisy environments is disclosed in a product catalog "Headset Transceiver GJH-103 with Microphone Cover" from Kanda Tsushin Kogyo Co., Ltd.

Further, although use is different from this "Headset Transceiver with Microphone Cover", a transmission device, in which a noise insulation cover is attached to a microphone in order to apply a voice to the microphone without leaking to its surroundings, is disclosed in Japanese Patent Application Publication (KOKAI) No. H5-207116, Japanese Patent Application Publication (KOKAI) No. H9-307614, and a product catalog "Sound Isolation Microphone Mute VMM-150" from MediaCom Japan Inc.

Incidentally, the voice is uttered simultaneously with exhalation through a mouth. Therefore, it is necessary to provide an opening (vent) for discharging exhalation through a noise insulation cover in a structure where the microphone is arranged in the noise insulation cover as disclosed in Japanese Patent Application Publication (KOKAI) No. H5-207116, Japanese Patent Application Publication (KOKAI) No. H9-307614, and the product catalog "Headset Transceiver GJH-103 with Microphone Cover" from Kanda Tsushin Kogyo Co., Ltd., the product catalog "Sound Isolation Microphone Mute VMM-150" from MediaCom Japan Inc.

On the other hand, in the case where the opening for discharging exhalation is provided in the noise insulation cover, noises enter into the noise insulation cover through the above-mentioned opening, so that a sound signal collected by the microphone is influenced by the above-mentioned noise.

Then, a long sound tube (for example) may be attached to the above-mentioned opening provided in the noise insulation cover for discharging exhalation, an air room which prevents a loud noise from entering may be provided, etc., to thereby prevent the noise from entering into the noise insulation cover. However, the whole noise insulation cover including peripherals, such as the above-mentioned sound tube, the air room, etc. increases in size, which is not practical.

SUMMARY OF THE INVENTION

The present invention arises in the above-mentioned technical background, and aims at providing a noise reduction transmitter which can secure clarity of voices collected in very noisy environments and maintain a quality of sounds without devising the above-mentioned noise insulation cover particularly.

The noise reduction transmitter in accordance with the present invention made in order to solve the above-mentioned problems is a noise reduction transmitter including a noise insulation cover worn on and covering at least a user's mouth, a transmission microphone arranged in the above-mentioned noise insulation cover, a noise detection microphone arranged outside the above-mentioned noise insulation cover to detect external noises, a noise component cancellation circuit for generating a noise component cancellation signal based on an output signal from the above-mentioned noise detection microphone, and an electroacoustic transducer arranged in the above-mentioned noise insulation cover to reproduce a noise component cancellation sound based on an output signal from the above-mentioned noise component cancellation circuit, wherein in addition to a voice uttered by the user, the noise component cancellation sound from the above-mentioned electroacoustic transducer is supplied to the above-mentioned transmission microphone so that an external noise component which reaches the transmission microphone through the above-mentioned noise insulation cover may be cancelled by the above-mentioned noise component cancellation sound.

In this case, in one preferred embodiment, it is arranged that a vent for breathing is provided at a part of the above-mentioned noise insulation cover.

Preferably, it is arranged that the above-mentioned noise component cancellation circuit is provided with a low-pass filter for selecting a low frequency component from output signals from the above-mentioned noise detection microphone, and the noise component cancellation signal is generated using the low frequency component selected by the above-mentioned low-pass filter.

In addition, in a preferred embodiment, a power amplifier for power amplifying the output signal from the noise component cancellation circuit is interposed between the above-mentioned noise component cancellation circuit and the above-mentioned electroacoustic transducer.

According to the noise reduction transmitter having the above-described structure, the voice uttered by the user is collected by the transmission microphone arranged in the noise insulation cover, and the external noise which reaches the transmission microphone can be insulated to some extent by the above-mentioned noise insulation cover.

In addition, based on the output signal from the noise detection microphone for detecting the external noise, the noise component cancellation signal is generated by the noise component cancellation circuit, and the electroacoustic transducer arranged in the noise insulation cover is driven by this cancellation signal.

Thus, the external noise component which reaches the transmission microphone through the above-mentioned noise insulation cover can be effectively cancelled by the noise component cancellation sound from the above-mentioned electroacoustic transducer, and the above-mentioned transmission microphone can provide the voice output which has considerably reduced the influence of the external noise.

Therefore, in the case where the noise insulation cover provided at its part with the vent for breathing is used, the external noise which reaches the transmission microphone through the above-mentioned vent can effectively be cancelled by the above-mentioned noise component cancellation sound.

Further, even if it is arranged that a gap is formed between a circumferential edge of the noise insulation cover and the user's face without providing the noise insulation cover with the vent for breathing, the similar cancellation effect can be demonstrated with respect to the external noise which reaches the transmission microphone through the above-mentioned gap.

Furthermore, even in the case where the above-mentioned noise insulation cover provided with the vent is used, and the noise insulation cover in which the gap is formed between the circumferential edge of the noise insulation cover and the user's face is used without opening the vent, fricative and plosive sounds generated in the user's mouth can be detected as a sound signal by the above-mentioned transmission microphone and it is possible to secure clarity of voices, thus providing the noise reduction transmitter which can maintain a quality of sounds.

DESCRIPTION OF THE PREFERRED EMBODIMENTS

Figure 1:
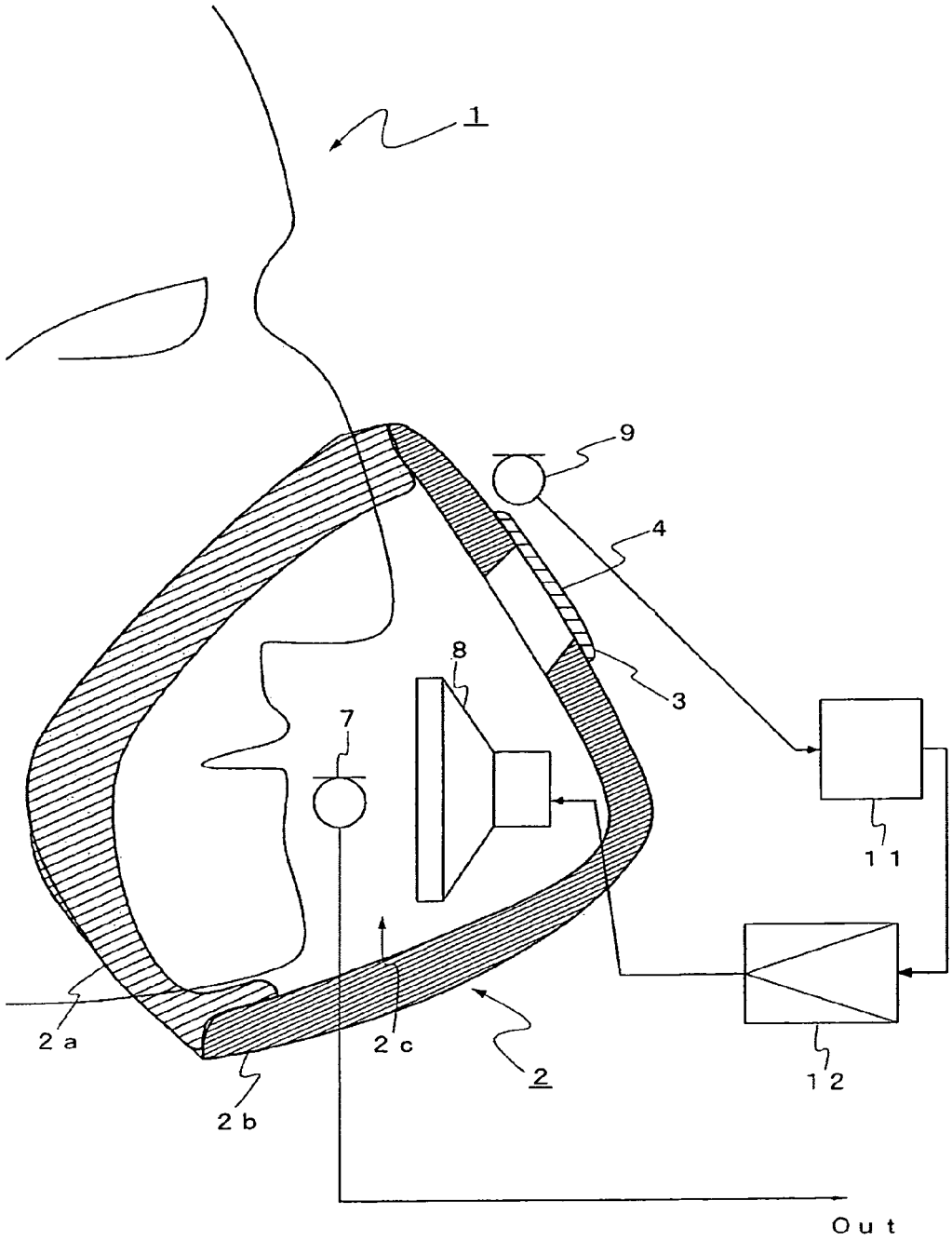
FIG. 1 is a schematic diagram showing a situation where a noise reduction transmitter in accordance with the present invention is worn on a user's face.

Hereinafter, a noise reduction transmitter in accordance with the present invention will be described with reference to a preferred embodiment shown in the drawings. Reference numeral 1 in FIG. 1 indicates a user's face schematically. A noise insulation cover 2 which constitutes the noise reduction transmitter in accordance with the present invention is worn on and covers at least a user's 1 mouth. In other words, in the example shown in FIG. 1, the noise insulation cover 2 is arranged to cover the user's 1 mouth and nose, when worn.

The above-mentioned noise insulation cover 2 is formed of an elastic material, and constituted by a circumferential edge 2*a* in close contact with part of a face around the user's 1 mouth and nose, and a cover body 2*b* formed integrally with this circumferential edge 2*a*, located in front of the face, and molded from a rubber material etc., for example.

The above-mentioned cover body 2*b* is arranged to be curved outwardly so that a comparatively large space 2*c* may be formed at the user's 1 mouth. In the example shown in the figure, a vent 3 is provided in a position somewhat higher than the central part of the above-mentioned cover body 2*b*.

This vent 3 allows breathing air from the user's 1 mouth or nose to pass and an acoustic resistor 4 of a porous sheet is provided to cover the vent 3 for the breathing.

Further, a transmission microphone 7 and an electroacoustic transducer (speaker) 8 are arranged in the above-mentioned noise insulation cover 2. In other words, the transmission microphone 7 is arranged to face the user's 1 mouth, and the electroacoustic transducer 8 is arranged to face the above-mentioned transmission microphone 7.

It should be noted that, in the schematic diagram showing in FIG. 1, the transmission microphone 7 and the electroacoustic transducer 8 are shown to float within the above-mentioned noise insulation cover 2, but these are attached to, for example, an inner surface of the above-mentioned cover body 2*b* by means of attachment members (not shown) etc.

Therefore, in addition to the voice uttered by the user, a reproduction sound from the above-mentioned electroacoustic transducer 8 is supplied to the above-mentioned transmission microphone 7.

On the other hand, reference numeral 9 indicates a noise detection microphone which is arranged outside the above-mentioned noise insulation cover 2 and detects an external noise. An output signal from this noise detection microphone 9 is arranged to be supplied to a noise component cancellation circuit 11.

The noise component cancellation signal generated by this noise component cancellation circuit 11 is supplied to a power amplifier 12 which power amplifies this signal. An output from this power amplifier 12 is arranged to drive the electroacoustic transducer 8 disposed inside the above-mentioned noise insulation cover 2.

It should be noted that, in the schematic diagram showing in FIG. 1, the noise detection microphone 9, the noise component cancellation circuit 11, and the power amplifier 12 are shown to float outside the above-mentioned noise insulation cover 2, but these are attached to, for example, an outer surface of the above-mentioned cover body 2*b* by means of attachment members (not shown) etc.

Figure 2:
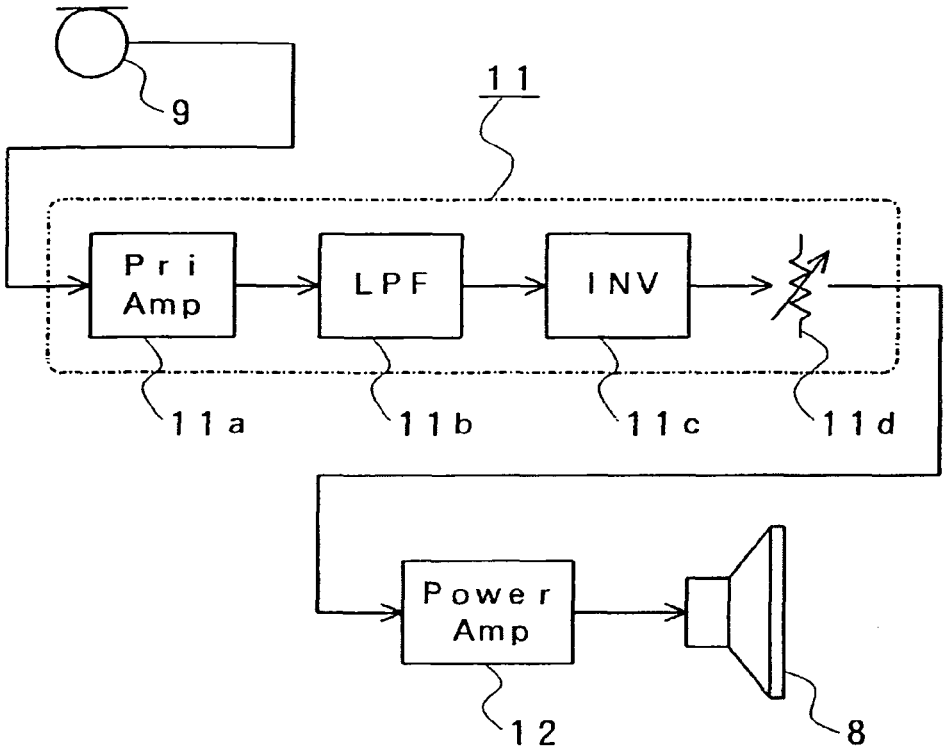
FIG. 2 is a block diagram showing an example of a structure of a drive circuit including a noise component cancellation circuit used for the noise reduction transmitter shown in FIG. 1.
Figure 3:
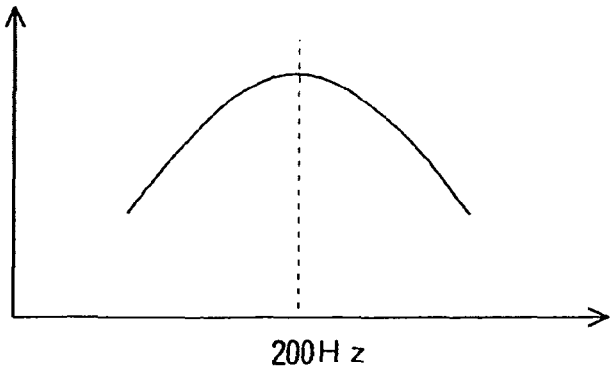
FIG. 3 is a characteristic graph illustrating an example of a low pass characteristic of the noise signal component used for the noise component cancellation circuit shown in FIG. 2.

FIGS. 2 and 3 show an example of a reproduction system of a noise component cancellation sound from the above-mentioned noise detection microphone 9 to the electroacoustic transducer 8. Hereinafter, with reference to FIGS. 2 and 3, a more detailed arrangement of the noise reduction transmitter in accordance with the present invention will be described.

The noise detection microphone 9 shown in FIG. 2 detects an external noise as described above, and the output signal is supplied to the noise component cancellation circuit 11 as described above.

The noise component cancellation circuit 11 shown in FIG. 2 is provided at its first stage with a preamplifier (voltage amplifier) 11*a*. It should be noted that when output sensitivity of the noise detection microphone 9 is large, the above-mentioned preamplifier 11*a* is not necessarily provided.

The output of the above-mentioned preamplifier 11*a* is applied to a low-pass filter 11*b* which selects a low frequency component, and the low frequency component selected by the above-mentioned low-pass filter 11*b* is used as the noise component cancellation signal.

The above-mentioned low-pass filter 11*b* has a characteristic of passing a low frequency wave around 200 Hz, for example, as shown in FIG. 3. In this preferred embodiment, the low frequency component obtained by this low-pass filter 11*b* is arranged to be phase inverted by a phase inversion circuit 11*c*.

In other words, the above-mentioned phase inversion circuit 11*c* generates the noise component cancellation signal based on a signal in anti-phase obtained by carrying out phase inversion of the low frequency component.

The noise component cancellation signal obtained by this phase inversion circuit 11*c* is adjusted in level by means of a potentiometer 11*d*, and it serves as an output of the noise component cancellation circuit 11.

Then, the noise component cancellation signal from the above-mentioned noise component cancellation circuit 11 is power amplified by the power amplifier 12 to drive the electroacoustic transducer 8 arranged in the above-mentioned noise insulation cover 2 and reproduce the noise component cancellation sound.

It should be noted that, the potentiometer 11*d* in the above-mentioned noise component cancellation circuit 11 controls the level of the noise component cancellation sound reproduced by the above-mentioned electroacoustic transducer 8, thereby adjusting the effect of canceling the noise component as will be described later.

The above-described noise component cancellation circuit 11 and the power amplifier 12 functionally differ in operation, and therefore are described separately in the figure. However, they can be formed on one substrate.

Further, the output phase of the electroacoustic transducer 8 can substantially be reversed by connecting output terminals of the power amplifier 12 to the electroacoustic transducer 8 in reverse in terms of positive and negative connections. Thus, by employing the reverse connection, the phase inversion circuit 11*c* in the above-mentioned noise component cancellation circuit 11 may be omitted.

Incidentally, as described above, the voice uttered by the user is applied to the transmission microphone 7 arranged in the noise insulation cover 2 shown in FIG. 1, and also the external noise entering through the above-mentioned vent 3 etc. formed in the noise insulation cover 2 is additionally applied to it.

In this case, since the external noise which reaches the transmission microphone 7 may be subjected to the acoustic resistance through the above-mentioned vent 3 etc. of the noise insulation cover 2, the low-pass component of the external noises is mainly added.

Then, the noise component cancellation sound generated by the noise component cancellation circuit 11 is reproduced by the above-mentioned electroacoustic transducer 8 facing the transmission microphone 7 and supplied to the transmission microphone 7.

As described above, the noise component cancellation sound supplied from the above-mentioned electroacoustic transducer 8 to the transmission microphone 7 is the low-pass component (of the noise components) subjected to the phase inversion. Thus, an external noise component which reaches the transmission microphone 7 through the noise insulation cover 2 is effectively cancelled by the noise component cancellation sound from the electroacoustic transducer 8, thereby considerably reducing the influence of noises in the transmission microphone 7.

On the other hand, the voice uttered by the user is collected by the transmission microphone 7 whose voice output can be supplied to a terminal Out.

In this case, as fricative and plosive sounds generated in the user's mouth can also be detected as a sound signal by the above-mentioned transmission microphone, it is possible to secure clarity of voices, thus providing the noise reduction transmitter which can maintain a quality of sounds.

It should be noted that, in the above-mentioned preferred embodiment, although the example in which the noise insulation cover 2 is provided with the vent 3 for breathing is illustrated, if a noise insulation cover with which a gap is formed between a circumferential edge of the noise insulation cover and the user's face is used without providing the noise insulation cover with the vent for breathing, the similar operational effect can be demonstrated.

Further, in the above-mentioned preferred embodiment, the phase inversion circuit 11*c* is used in the noise component cancellation circuit 11.

This is because a distance between the above-mentioned noise detection microphone 9 and the transmission microphone 7 is small, a low frequency wave around 200 Hz (for example) gives small phase rotation, and a sufficient noise-cancellation effect can be expected.

However, a phase conversion circuit (phase shifter circuit) which can change and adjust the extent of the phase rotation as needed can also be used instead of the phase inversion circuit.

What is claimed is:

1. A noise reduction transmitter, comprising a noise insulation cover worn on and covering at least a user's mouth, a transmission microphone arranged in said noise insulation cover, a noise detection microphone arranged outside said noise insulation cover to detect external noises, a noise component cancellation circuit for generating a noise component cancellation signal based on an output signal from said noise detection microphone, and an electroacoustic transducer arranged in said noise insulation cover to reproduce a noise component cancellation sound based on an output signal from said noise component cancellation circuit, wherein in addition to a voice uttered by the user, the noise component cancellation sound from said electroacoustic transducer is supplied to said transmission microphone so that an external noise component which reaches the transmission microphone through said noise insulation cover may be cancelled by said noise component cancellation sound.

2. A noise reduction transmitter as claimed in claim 1, wherein a vent for breathing is provided at a part of said noise insulation cover.

3. A noise reduction transmitter as claimed in claim 1, wherein said noise component cancellation circuit is provided with a low-pass filter for selecting a low frequency component from output signals from said noise detection microphone, and the noise component cancellation signal is generated using the low frequency component selected by said low-pass filter.

4. A noise reduction transmitter as claimed in any one of claims 1 to 3, wherein a power amplifier for power amplifying the output signal from the noise component cancellation circuit is interposed between said noise component cancellation circuit and said electroacoustic transducer.

* * * * *